US007013486B1

(12) United States Patent
Sullivano et al.

(10) Patent No.: US 7,013,486 B1
(45) Date of Patent: Mar. 21, 2006

(54) BALL GLOVE FORMED WITH ABRASION RESISTANT MATERIAL

(75) Inventors: Brian A. Sullivano, St. Charles, IL (US); Shigeaki Aso, Hoffman Estates, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 10/959,795

(22) Filed: Oct. 6, 2004

(51) Int. Cl.
*A41D 19/00* (2006.01)

(52) U.S. Cl. ..... 2/19

(58) Field of Classification Search ..... 2/16, 2/20, 159, 160, 161.1, 161.2, 19, 161.6, 161.3, 2/163, 161.8
See application file for complete search history.

(56) References Cited

U.S. PATENT DOCUMENTS

| | | | | | |
|---|---|---|---|---|---|
| 2,417,996 | A | * | 3/1947 | Stobbe | 2/19 |
| 2,632,171 | A | * | 3/1953 | Kuh | 2/161.6 |
| 4,197,592 | A | * | 4/1980 | Klein | 2/161.1 |
| 4,507,807 | A | * | 4/1985 | Karkanen | 2/161.8 |
| 5,231,700 | A | * | 8/1993 | Cutshall | 2/161.7 |
| 5,572,739 | A | | 11/1996 | Kolada et al. | 2/19 |
| 5,752,279 | A | * | 5/1998 | Hochmuth | 2/161.1 |
| 5,774,897 | A | * | 7/1998 | Hochmuth | 2/161.1 |
| 5,974,588 | A | * | 11/1999 | Furman | 2/159 |
| 6,009,557 | A | * | 1/2000 | Witta | 2/159 |
| 6,052,829 | A | * | 4/2000 | Kindler | 2/167 |
| 6,305,022 | B1 | | 10/2001 | Oomura et al. | 2/19 |
| 6,370,691 | B1 | | 4/2002 | Park | 2/19 |
| 6,393,616 | B1 | * | 5/2002 | Woodard | 2/163 |
| 6,557,178 | B1 | * | 5/2003 | Hoover | 2/161.6 |
| 6,654,965 | B1 | * | 12/2003 | Hochmuth | 2/161.1 |
| 6,681,401 | B1 | | 1/2004 | Marino | 2/19 |
| 6,681,402 | B1 | | 1/2004 | Bevier et al. | 2/19 |

* cited by examiner

*Primary Examiner*—Gary L. Welch
(74) *Attorney, Agent, or Firm*—Terence P. O'Brien

(57) ABSTRACT

A ball glove including a front glove portion, a back glove portion, at least one abrasion resistant segment, and a webbing. The back glove portion is coupled to the front glove portion to define a hand cavity and to form first, second, third and fourth finger stalls and a thumb stall. Each finger stall includes a distal region, a proximal region, and a central region positioned between the distal and proximal regions. The abrasion resistant segment is coupled to the distal region of at least one of the finger stalls. The webbing is coupled to, and positioned between, the first finger stall and the thumb stall.

26 Claims, 7 Drawing Sheets

BALL GLOVE FORMED WITH ABRASION RESISTANT MATERIAL

FIELD OF THE INVENTION

The present invention relates generally to a ball glove for baseball, softball and other sports. In particular, the present invention relates to a ball glove having a plurality of finger stalls and abrasion resistant material attached to the tips of at least one of the finger stalls.

BACKGROUND OF THE INVENTION

Ball gloves for use in baseball, softball and other sports are well known. Ball gloves typically include a front panel connected to a corresponding back panel to form a hand cavity. The front and back panels typically generally resemble the shape of a human hand and when assembled form five stalls for receiving the thumb and fingers of a user's hand. The front and back panels form a hand opening at the lower edge of the glove. A webbing is typically connected between the thumb stall and the index finger stall of the ball glove. Ball gloves also typically include a hand opening for enabling a user to insert his or her hand into the hand cavity of the ball glove, and, often, an index finger hole for enabling the user's index finger to rest on the back portion of the index finger stall during use. Many existing ball gloves are formed of high quality, relatively expensive materials, such as natural leather, synthetic leather, and combinations thereof.

Ball gloves are typically very durable, and outside of certain high wear areas, generally can serve a user well for several years. Existing ball gloves, however, are generally susceptible to excessive wear at the distal ends, or tips, of the finger and thumb stalls. These areas of the ball glove are often routinely scraped, dragged or swiped along the playing surface during play. In particular, the tips of the finger and thumb stalls of a ball glove often are scraped along the playing surface upon fielding ground balls, fielding low thrown or hit balls, and applying a tag to an opposing sliding player. As a result, many ball gloves, including premium, high-end leather ball gloves, can develop scratches, scrapes, holes and other evidence of wear at the tips of the finger and thumb stalls. This wear can lead to premature failure of the ball glove. Further, many used ball gloves retain the appearance of a new glove, with the exception of excessive scrapes and marks worn into the tips of the finger and thumb stalls of the ball glove. Such wear marks are particularly visible on darker colored ball gloves.

Thus, there is a continuing need for a ball glove that is less susceptible to scratches, scrapes and other types of wear. It would be advantageous to provide a ball glove with improved wear resistance in high wear areas, without negatively affecting the weight, comfort, appearance or performance of the glove. It would also be advantageous to provide a ball glove that provides these advantages in a manner that increases the durability of the glove without substantially increasing the cost or complexity of the glove.

SUMMARY OF THE INVENTION

The present invention provides a ball glove including a front glove portion, back glove portion, at least one abrasion resistant segment, and a webbing. The back glove portion is coupled to the front glove portion to define a hand cavity and to form first, second, third and fourth finger stalls and a thumb stall. Each finger stall includes a distal region, a proximal region, and a central region positioned between the distal and proximal regions. The abrasion resistant segment is coupled to the distal region of at least one of the finger stalls. The webbing is coupled to, and positioned between, the first finger stall and the thumb stall.

According to a principal aspect of a preferred form of the invention, a ball glove includes a hand region, first, second, third and fourth finger stalls and a thumb stall, at least one abrasion resistant segment, and a webbing. Each of the first, second, third and fourth finger stalls and a thumb stall have an outer surface. The at least one abrasion resistant segment is coupled to at least one of the finger and thumb stalls. The abrasion resistant segment covers at least 10 percent of the outer surface of the at least one of the finger and thumb stalls. The webbing is coupled to, and positioned between, the first finger stall and the thumb stall.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
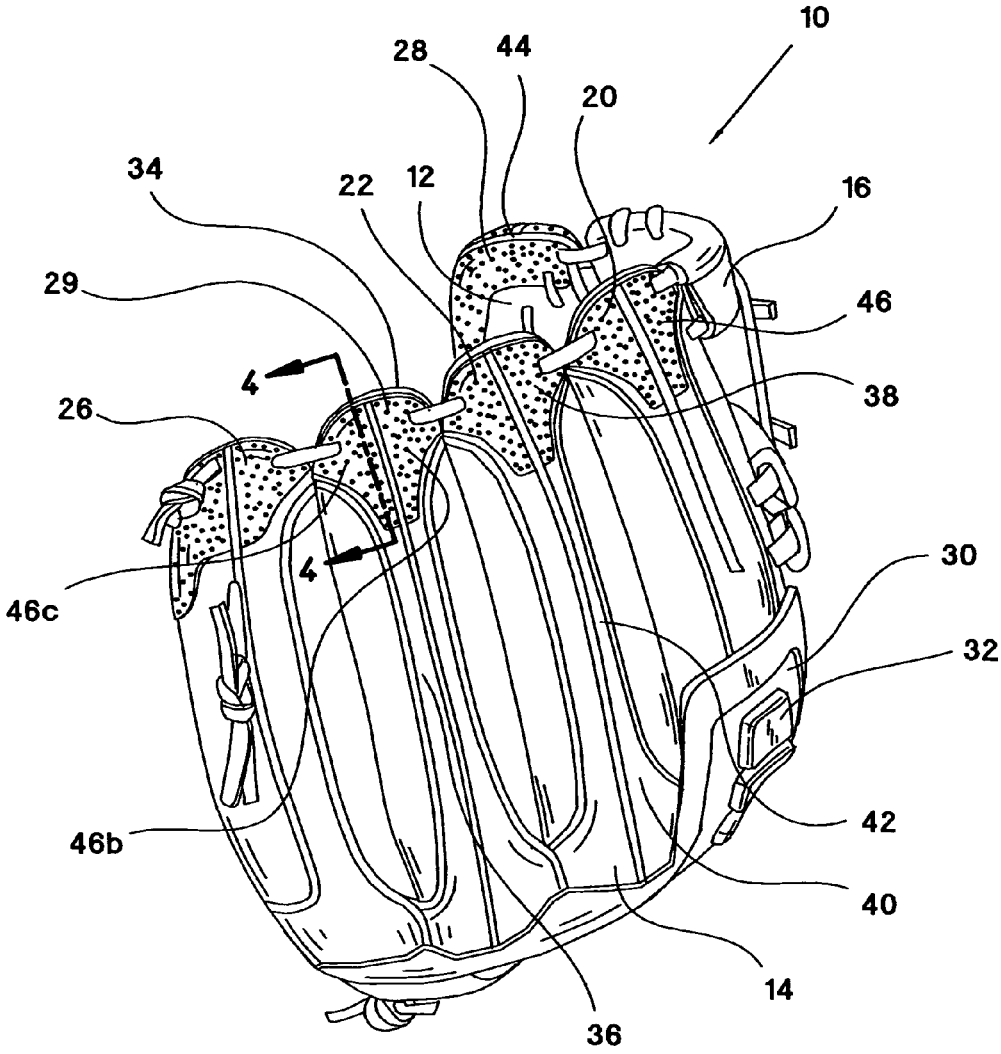
FIG. 1 is a back view of a ball glove in accordance with a preferred embodiment of the present invention.
Figure 2:
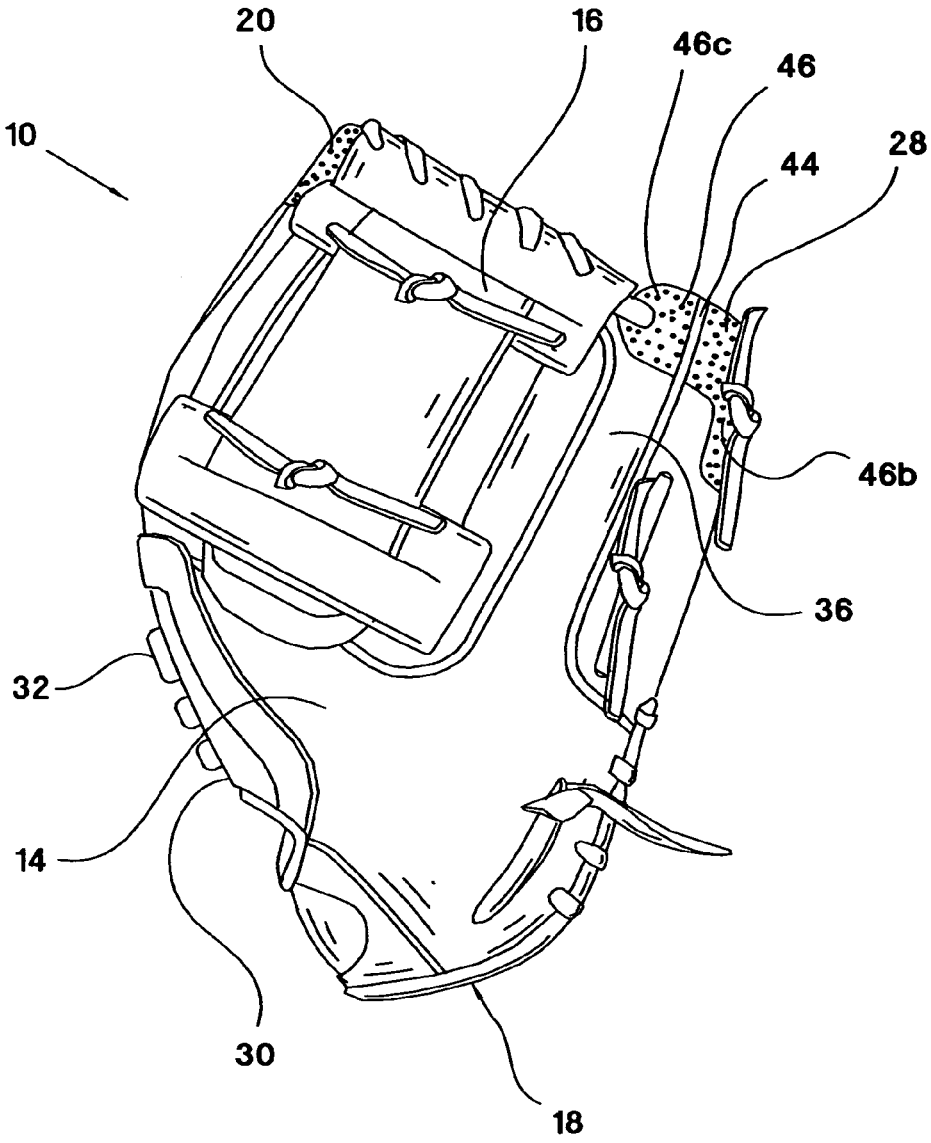
FIG. 2 is a side view of the ball glove of FIG. 1.
Figure 3:
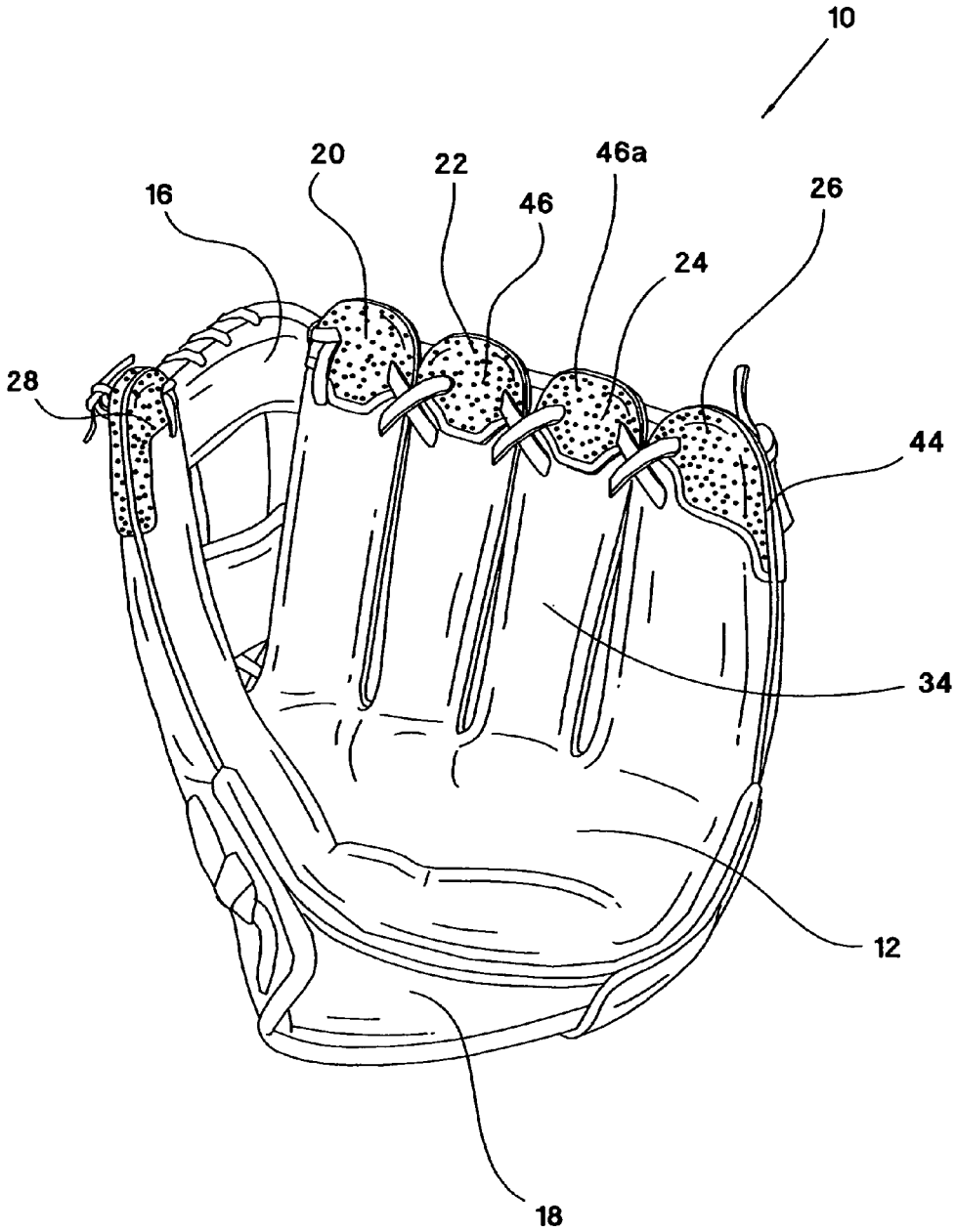
FIG. 3 is a front view of the ball glove of FIG. 1.

Referring to FIGS. 1 through 3, a ball glove is indicated generally at 10. The ball glove 10 is configured for use in baseball, softball, hockey and other sports involving ball gloves. The ball glove 10 can also be referred to as a mitt. The present invention is directly applicable to any ball glove or ball mitt including, for example, a first baseman mitt and a catcher's mitt. The ball glove 10 includes a front glove portion 12, a back glove portion 14 and a webbing 16.

The front and back portions 12 and 14 are contoured sheet-like structures, each resembling a hand. The front and back portions 12 and 14 are connected together to define a hand cavity 18, and to form first, second, third and fourth finger stalls 20, 22, 24, 26, and a thumb stall 28. The front and back portions 12 and 14 are preferably stitched together. In one preferred embodiment, the front and back portions 12 and 14 are coupled together through the use of weltings. Alternatively, the front and back portions 12 and 14 can be connected through other means, such as, for example, bonding, molding or adhesives. The front portion 12 covers and protects the palm-side of the user's hand from impact with the ball. The back portion 14 supports the front portion 12 and protects the backside of the user's hand. The front and back portions 12 and 14 are made of a pliable, durable, and relatively soft material, preferably leather. In alternative preferred embodiments, the front and back portions 12 and 14 can be made of other materials, such as, for example, artificial leather, composite leather, rubber and plastic. The webbing 16 is a generally flat structure that is connected, and preferably stitched, to the front and back portions 12 and 14 between the first finger stall 20 and the thumb stall 28. The back glove portion 14 also preferably includes an index finger protector 30 formed into, or connected to, the first finger stall 20. The index finger protector 30 provides the user with the flexibility of leaving his or her index finger within the first finger stall 20 or on the back side of the first finger stall 20. Preferably, the index finger protector 30 also includes at least one touch pad 32 for contact by the user's index finger. In one particularly preferred embodiment three touch pads 32 are arranged in a spaced apart manner along the back of the first finger stall 20.

The finger stalls 20–26 and the thumb stall 28 are elongate cavities adapted for receiving the fingers and thumb of the user. Each finger stall 20–26 and thumb stall 28 includes a front stall portion 34 and a back stall portion 36. Each finger stall 20–26 and thumb stall 28 also includes a distal region 38, a proximal region 40 and a central region 42 positioned between the distal and proximal regions 38 and 40. The front and back stall portions 34 and 36 are coupled to each other, preferably through a plurality of weltings 44, lacings and stitchings. Alternatively, the front and back stall portions 34 and 36 can be connected through other means, such as, for example, stitching only, bonding, or molding.

At least one abrasion resistant segment 46 is coupled to at least one of the finger and thumb stalls 20–28. In alternative preferred embodiments, a separate abrasion resistant segment 46 is coupled to one, two, three, four or all of the finger and thumb stalls 20–28. The abrasion resistant segments 46 are preferably coupled to the finger and/or thumb stalls 20–28 through stitching and adhesive bonding. In alternative preferred embodiments, the abrasion resistant segment 46 can be attached to the finger and/or thumb stalls 20–28 through other conventional means or combinations of such means. For example, the abrasion resistant members can be coupled through hook and loop type fastening, other adhesives, thermal bonding, molding, etc.

The abrasion resistant segment 46 is a thin protective member formed of abrasion resistant material, such as, for example, a polyester, a nylon, a leather, a synthetic leather, a plastic, a polymer, other abrasion resistant materials or combinations thereof. The abrasion resistant segments 46 inhibit wear, scratching, abrasion, punctures and other forms of wear or damage to the finger and/or thumb stalls 20–28. The abrasion resistant segments 46 are generally more durable, tougher, harder and/or stiffer than the outer layer of the front and back stall portions 34 and 36. The abrasion resistant segments are configured to withstand more abrasions and other abuse during play and to show significantly less wear and tear than the existing material used on the outer layer of the finger and thumb stalls. Specifically, the abrasion resistant segment preferably has a Shore D hardness value that is greater than that of the outer layer of the front and back stall portions 34 and 36. The abrasion resistant segments 46 can be formed as flexible members or as generally rigid members shaped to generally match the contour of the finger or thumb stall region to which it's attached. The outer surface of the abrasion resistant segments 46 is preferably formed with a roughened texture. Alternatively, the outer surface of the abrasion resistant segments can be formed with different textures, such as, for example, pebbled, smooth, grainy and combinations thereof.

The abrasion resistant segment 46 is preferably attached to at least the distal region 38 of the finger or thumb stalls 20–28. In a particularly preferred embodiment, the at least one abrasion resistant segment 46 is a plurality of abrasion resistant segments that substantially cover the distal region 38 of each finger and thumb stall 20–28. More particularly, each finger and thumb stall 20–28 can include three separate abrasion resistant segments 46 *a, b* and *c*, wherein a first abrasion resistant segment 46*a* covers the distal region of the front stall portion 34 and second and third segments 46 *b* and *c* combine to substantially cover the distal region of the back stall portion 36. In alternative preferred embodiments, the abrasion resistant segment(s) can be configured to cover only the distal region of the front stall portion 34 of each finger and/or thumb stall, or to cover only the distal region of the back stall portion 36 of each finger and/or thumb stall. The abrasion resistant segment(s) 46 preferably extends over at least 5 percent of the outer surface of the finger or thumb stall 20–28 to which it's applied. In alternative preferred embodiments, the abrasion resistant segment 46 can be sized to extend over at least 10, 20, 30 or 40 percent of the outer surface of the finger or thumb stall 20–28 to which it's applied.

The abrasion resistant segments can be formed of one or more colors and/or textures, or differing colors and/or textures. Accordingly, a single finger or thumb stall can include two or more abrasion resistant segments having differing colors and/or textures. Alternatively, the texture and/or color of the abrasion resistant segments can also vary from stall to stall.

Figure 4:
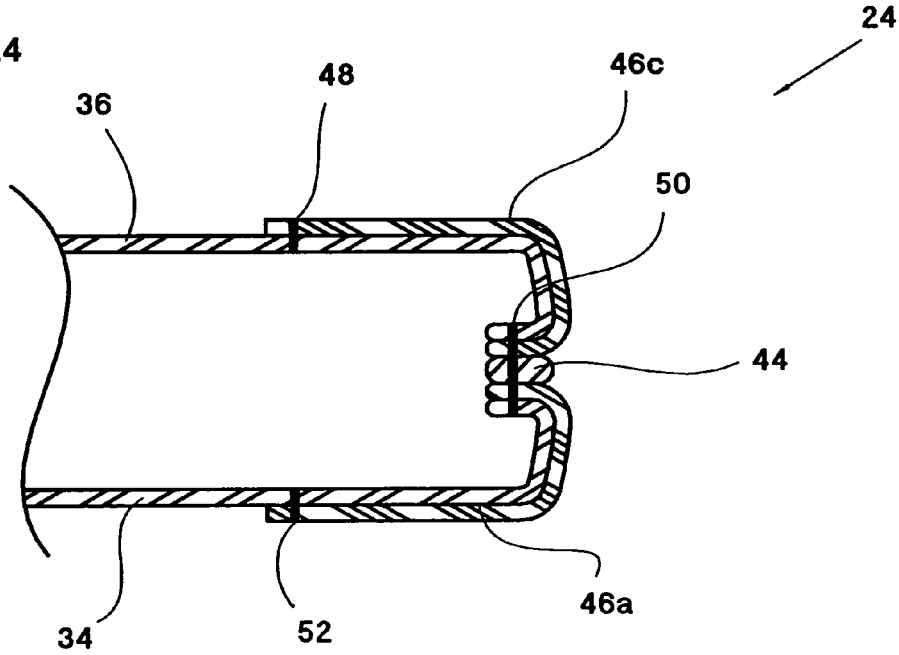
FIG. 4 is a cross-sectional view of a finger stall of the ball glove taken along line 4—4 of FIG. 1.

Referring to FIG. 4, the attachment of the abrasion resistant 46 segment to a finger or thumb stall, and in particular, the third finger stall 24, is shown in greater detail. A first edge region of the abrasion resistant segment 46*c* is preferably stitched to the back stall portion 36 of third finger stall 24 through a stitching 48 and a second edge region of the abrasion resistant segment 46*c* is attached to the welting 44, the front stall portion 34 and the abrasion resistant segment 46*a* through stitching 50. The abrasion resistant segment 46*a* is also attached to the front stall portion 34 through a stitching 52. The abrasion resistant segment 46*b*, although not shown in FIG. 4, is attached in a manner similar to abrasion resistant segment 46*c*. The abrasion resistant segment 46 is also preferably attached to the finger stall 24 through an adhesive (not shown). The abrasion resistant segment 46 provides an extra layer of material above and beyond the outer layer of the front and back stall portions 34 and 36.

Figure 5:
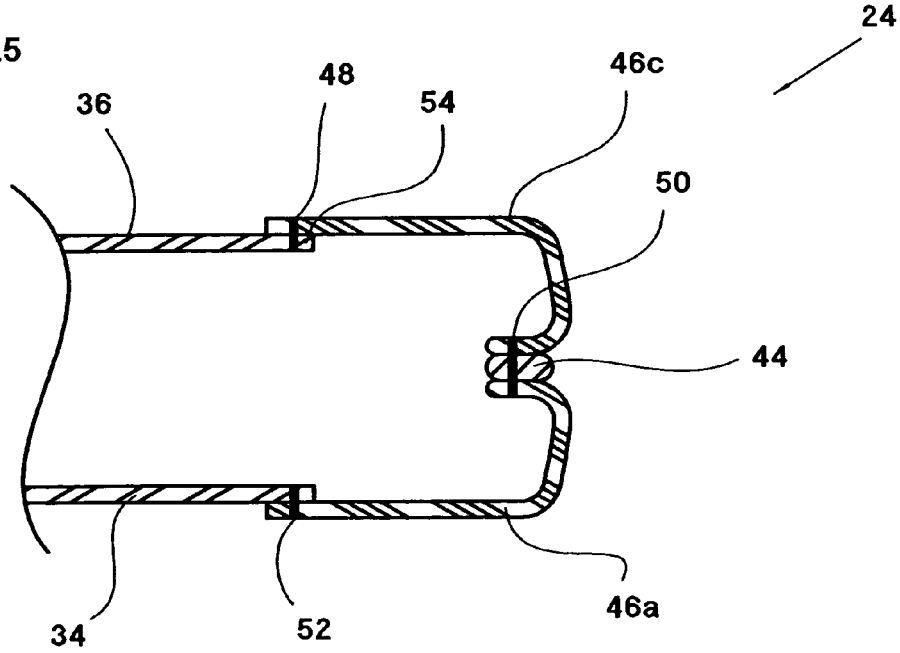
FIG. 5 is a cross-section view of a finger stall of a ball glove in accordance with an alternative preferred embodiment of the present invention.

Referring to FIG. 5, an alternative preferred embodiment for the attachment of the abrasion resistant segment 46 to the finger stall 24 is shown. In this alternative preferred embodiment, the front and back stall portions 34 and 36 terminate at a distal edge region 54, and the abrasion resistant segments 46*a* and 46*c* are attached to the distal edge region 54 through the stitchings 48 and 52, respectively. The abrasion resistant segments 46*c* and 46*a* are also attached to each other through the welting 44 by the stitching 50. In this alternative preferred embodiment, the abrasion resistant segment 46 enables the distal end of the front and back stall portions 34 and 36 to be removed thereby saving material cost and reducing the weight of the ball glove 10. The attachment of the abrasion resistant segment 46*a* to the distal edge region 54 preferably allows for partial overlapping of the abrasion resistant segment 46*a* with the distal edge region 54. In alternative embodiments, the connection of the abrasion resistant segment and the distal edge region can be substantially end to end with little or no overlapping, or the distal edge region can be positioned to partially overlap the abrasion resistant segment.

Figure 6:
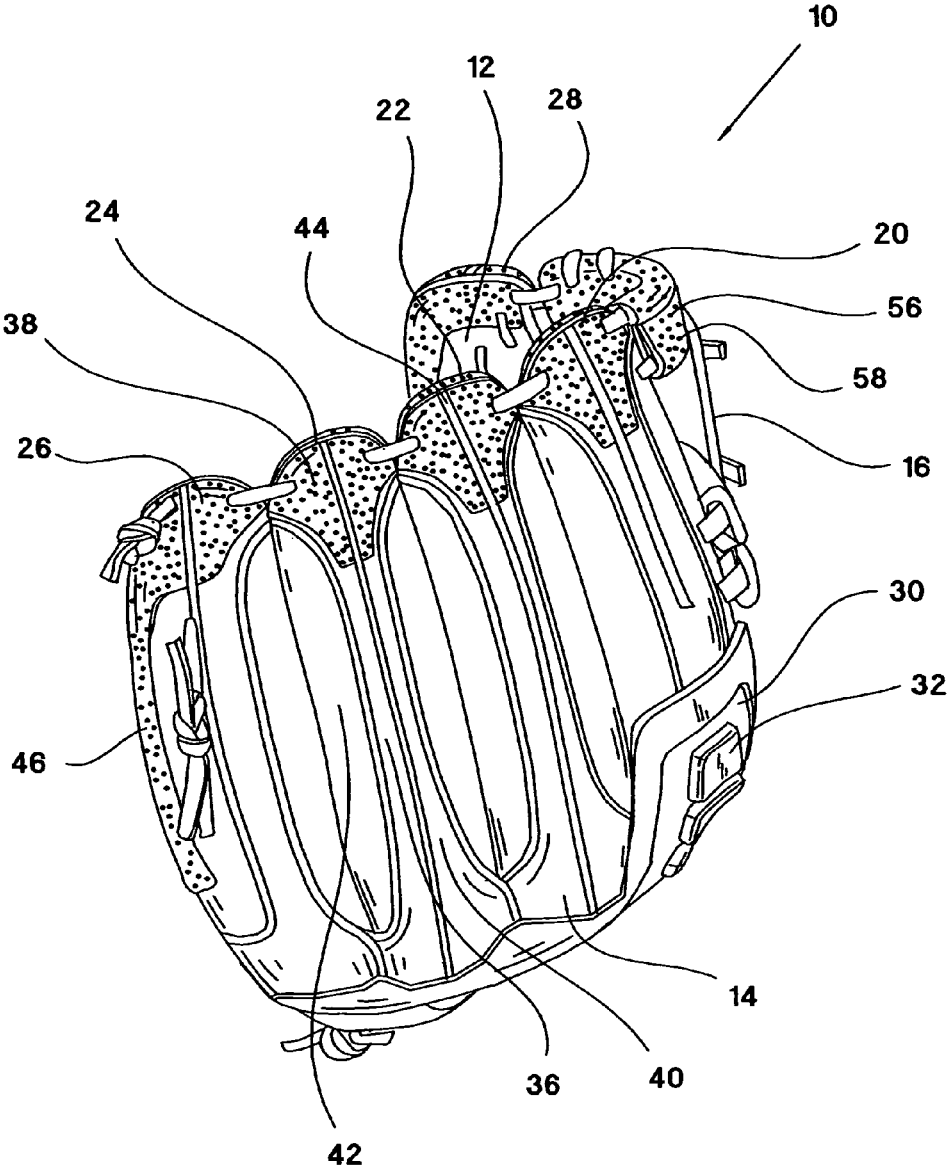
FIG. 6 is a back view of a ball glove in accordance with another alternative preferred embodiment of the present invention.
Figure 7:
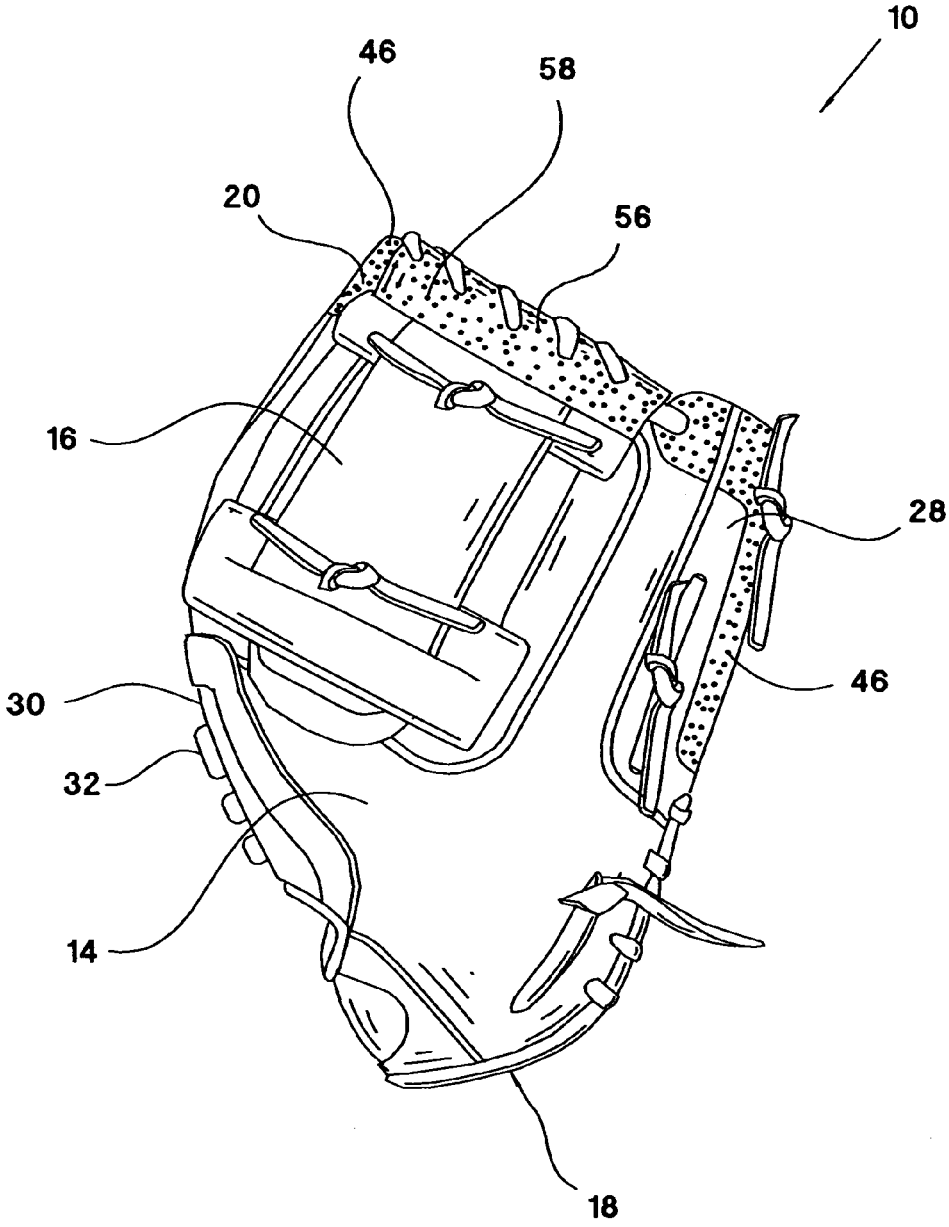
FIG. 7 is a side view of the ball glove of FIG. 6.
Figure 8:
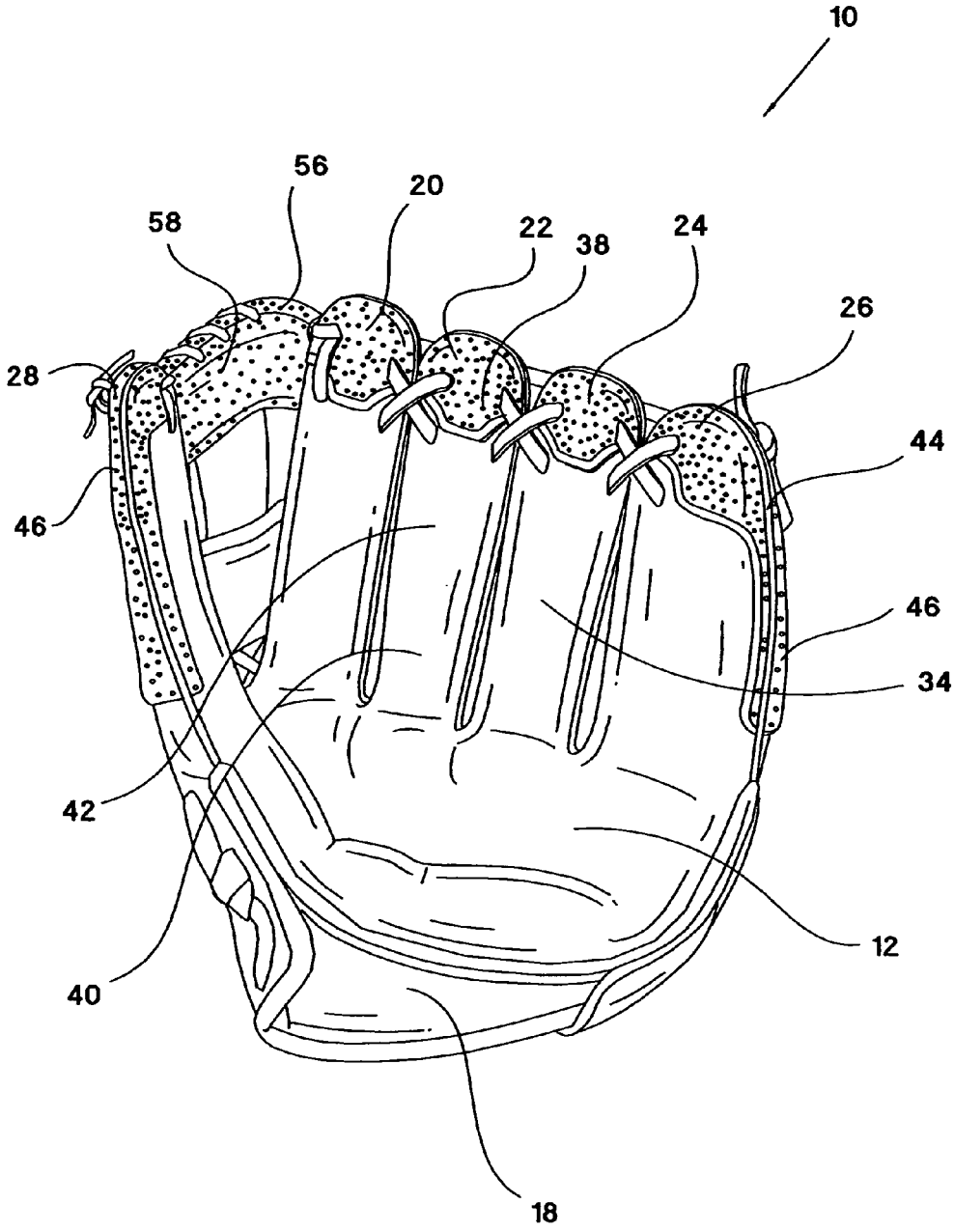
FIG. 8 is a front view of the ball glove of FIG. 6.

Referring to FIGS. 6–8, in another alternative embodiment of the present invention the abrasion resistant segments 46 can also extend along the outer sides of the fourth finger stall 26 and the thumb stall 28. The outer sides of the fourth finger stall 26 and thumb stall 28 are other regions of the ball glove 10 that are susceptible to premature wear, abrasions, etc. In yet another alternative preferred embodiment, the webbing 16 can also include an abrasion resistant webbing segment 56 extending over a distal region 58 of the webbing 16. The distal region 58, like the distal ends of the finger and thumb stalls 20–28, is also susceptible to wear, scratching, abrasion etc. during normal use. The abrasion resistant webbing segment 56 inhibits such wear, scratching and abrasions. The abrasion resistant webbing segment 56 is substantially similar to the abrasion resistant segment 46.

The abrasions resistant segments and that abrasion resistant webbing segment inhibit and resist wear, punctures, scrapes and other types of damage enabling a used ball glove to retain a like new appearance. The abrasion resistant segments also help prevent premature failure of the ball glove due to excessive wear. The abrasion resistant segments provide the ball glove with these added benefits without significantly increasing the cost or complexity of the ball glove, and without negatively affecting the appearance or the weight of the ball glove. In other alternative preferred embodiments, the abrasion resistant segments can be placed in other locations about the ball glove to assist in preventing premature wear of the ball glove.

While the preferred embodiments of the present invention have been described and illustrated, numerous departures therefrom can be contemplated by persons skilled in the art. For example, one or more of the abrasion resistant segments can be releasably and replaceably connected to the glove. Therefore, the present invention is not limited to the foregoing description but only by the scope and spirit of the appended claims.

The invention claimed is:

1. A ball glove comprising:

a front glove portion;

a back glove portion coupled to the front glove portion to define a hand cavity and to form first, second, third and fourth finger stalls and a thumb stall, each finger stall including a distal region, a proximal region, and a central region positioned between the distal and proximal regions;

at least one abrasion resistant segment coupled to the distal region of at least one of the finger stalls; and a webbing coupled to, and positioned between, the first finger stall and the thumb stall.

2. The ball glove of claim 1, wherein at least two of the first, second, third and fourth finger stalls each include at least at least one separate abrasion resistant segment.

3. The ball glove of claim 1, wherein at least three of the first, second, third and fourth finger stalls each include at least at least one separate abrasion resistant segment.

4. The ball glove of claim 1, wherein each of the first, second, third and fourth finger stalls include at least at least one separate abrasion resistant segment.

5. The ball glove of claim 1, wherein each of the first, second, third and fourth finger stalls and the thumb stall include at least one separate abrasion resistant segment.

6. The ball glove of claim 1, wherein at least two abrasion resistant segments are coupled to the distal region of at least one of the finger stalls.

7. The ball glove of claim 1, wherein the at least one abrasion resistant segment is coupled to only one of the front portion and the back portion of the ball glove.

8. The ball glove of claim 1, wherein the webbing includes a distal edge region, and wherein at least one abrasion resistant segment is coupled to the distal edge region of the webbing.

9. The ball glove of claim 1, wherein the abrasion resistant segment is formed of a material selected from the group consisting of a polyester, a nylon, a leather, a synthetic leather, a plastic, a polymer, other abrasion resistant materials, and combinations thereof.

10. The ball glove of claim 1, wherein the at least one abrasion resistant segment is laid over an outer surface of at least one of the finger stalls at the distal region such that the abrasion resistant segment forms a second layer disposed over the outer surface.

11. The ball glove of claim 1, wherein the finger stall terminates at a distal edge on at least one of the finger stalls, and wherein the at least one abrasion resistant segment couples to the finger stall at or near the distal edge.

12. The ball glove of claim 11, wherein a majority of the abrasion resistant material does not overlap the finger stall.

13. The ball glove of claim 1, wherein an outer surface of the finger stall is formed of a first material, wherein the at least one abrasion resistant segment is formed of a second material that is different from the first material.

14. The ball glove of claim 13, wherein the hardness of the second material is greater than the hardness of the first material.

15. The ball glove of claim 1, wherein the abrasion resistant material extends over at least 10 percent of the outer surface of the at least one finger stall.

16. The ball glove of claim 1, wherein the abrasion resistant material extends over at least 20 percent of the outer surface of the at least one finger stall.

17. The ball glove of claim 1 wherein the abrasion resistant segment has an outer surface, and wherein the outer surface has a texture selected from the group consisting of smooth, pebbled, grainy and roughened.

18. A ball glove comprising:

a hand region, first, second, third and fourth finger stalls and a thumb stall, each of the first, second, third and fourth finger stalls and a thumb stall having an outer surface;

at least one abrasion resistant segment coupled to at least one of the finger and thumb stalls, the abrasion resistant segment covering at least 10 percent of the outer surface of the at least one of the finger and thumb stalls; and a webbing coupled to, and positioned between, the first finger stall and the thumb stall.

19. The ball glove of claim 18, wherein each finger stall includes a distal region, a proximal region, and a central region positioned between the distal and proximal regions, and wherein the abrasion resistant segment is coupled to the distal region of the finger stall.

20. The ball glove of claim 18, wherein each of the first, second, third and fourth finger stalls include at least at least one separate abrasion resistant segment.

21. The ball glove of claim 18, wherein each of the first, second, third and fourth finger stalls and the thumb stall include at least one separate abrasion resistant segment.

22. The ball glove of claim 18, wherein at least two abrasion resistant segments are coupled to the distal region of at least one of the finger stalls.

23. The ball glove of claim 18, wherein the webbing includes a distal edge region, and wherein at least one abrasion resistant segment is coupled to the distal edge region of the webbing.

24. The ball glove of claim 18, wherein the abrasion resistant segment is formed of a material selected from the group consisting of a polyester, a nylon, a leather, a plastic, a polymer, other abrasion resistant materials, and combinations thereof.

25. The ball glove of claim 18, wherein the finger and thumb stalls include an outer surface, wherein the at least one abrasion resistant segment is laid over at least one of the finger and thumb stalls at the distal region such that the abrasion resistant segment forms a second layer disposed over the outer surface.

26. The ball glove of claim 18, wherein the abrasion resistant segment extends over at least 20 percent of the outer surface of the at least one of the finger and stalls.

* * * * *